United States Patent [19]

Levine

[11] Patent Number: 4,932,529

[45] Date of Patent: Jun. 12, 1990

[54] DISPLAY AND STORAGE CONTAINER WITH A LINER HAVING A SPACER FLAP FOR PHOTOGRAPHIC PRINTS

[75] Inventor: Howard M. Levine, Valencia, Calif.

[73] Assignee: Print Technology, Inc., Santa Monica, Calif.

[21] Appl. No.: 329,384

[22] Filed: Mar. 27, 1989

[51] Int. Cl.[5] ..... B65D 85/00

[52] U.S. Cl. ..... 206/455; 40/642; 206/215

[58] Field of Search ..... 206/215, 425, 449, 450, 206/455, 453, 451, 526, 44 B, 555, 556; 40/511, 513, 642

[56] References Cited

U.S. PATENT DOCUMENTS

| | | | |
|---|---|---|---|
| 423,059 | 3/1890 | Lear . | |
| 2,019,802 | 11/1935 | Sproull | 206/215 |
| 2,207,917 | 7/1940 | Fleischer | 206/215 X |
| 2,354,706 | 8/1944 | Rulon | 206/455 |
| 2,502,214 | 3/1950 | Gianninoto | 206/215 |
| 2,600,927 | 6/1952 | Scoville | 206/215 |
| 2,649,799 | 8/1950 | Spertus . | |
| 3,043,487 | 7/1962 | Fowle | 206/455 X |
| 3,173,537 | 3/1965 | Doyle | 206/455 |
| 3,185,298 | 5/1965 | Verspecht | 206/455 |
| 3,272,325 | 9/1966 | Schoenmakers . | |
| 3,369,730 | 2/1968 | Bowman | 206/215 |
| 3,377,727 | 4/1968 | Weggeland . | |
| 3,771,244 | 11/1973 | Ebner . | |
| 3,787,992 | 1/1974 | Leonhardt . | |
| 4,185,745 | 1/1980 | Moser et al. | 206/556 |
| 4,235,334 | 11/1980 | Ahn . | |
| 4,241,529 | 12/1980 | Baur | 40/513 |
| 4,242,820 | 1/1981 | Ackeret . | |
| 4,293,266 | 10/1981 | St. Lawrence et al. . | |
| 4,310,091 | 1/1982 | Hara et al. . | |
| 4,350,248 | 9/1982 | Bauer | 206/455 |
| 4,356,918 | 11/1982 | Kahle et al. | 206/444 |
| 4,413,435 | 11/1983 | Bauer . | |
| 4,458,434 | 7/1984 | Ackeret . | |
| 4,483,085 | 11/1984 | Barton . | |
| 4,571,865 | 2/1986 | Ackeret . | |
| 4,666,036 | 5/1987 | Bourbon | 206/425 |
| 4,691,456 | 9/1987 | Ackeret . | |
| 4,720,733 | 1/1988 | Otake et al. . | |
| 4,736,538 | 4/1988 | Pierce et al. . | |
| 4,768,299 | 9/1988 | Ackeret . | |
| 4,774,779 | 10/1988 | Ackeret | 40/642 |

FOREIGN PATENT DOCUMENTS

| | | | |
|---|---|---|---|
| 437718 | 4/1912 | France | 206/449 |
| 369803 | 3/1932 | United Kingdom | 206/455 |
| 2088337A | 6/1982 | United Kingdom . | |

*Primary Examiner*—Bryon P. Gehmon
*Attorney, Agent, or Firm*—Bacon & Thomas

[57] ABSTRACT

A container is disclosed for storing a stack of photographic prints and their negatives as well as for displaying one of the photographs. The container has a base to which a cover is pivotally attached. The cover has a front wall with a peripheral contour and defines a display opening having a contour smaller than that of the front wall peripheral contour. The cover has a transport wall spaced from the front wall to accommodate a stack of photographic prints. Locating elements extend between the transport wall and the front wall to precisely locate the stack of photographic prints with respect to the display opening in the front wall. When the cover and base are closed, the container not only stores the stack of photographic prints and the negatives, but also provides a convenient device for displaying one of the prints. A spacer to accommodate stacks of variable thickness is provided with a liner to hold the stack and negatives in the container.

26 Claims, 8 Drawing Sheets

FIGURE 1
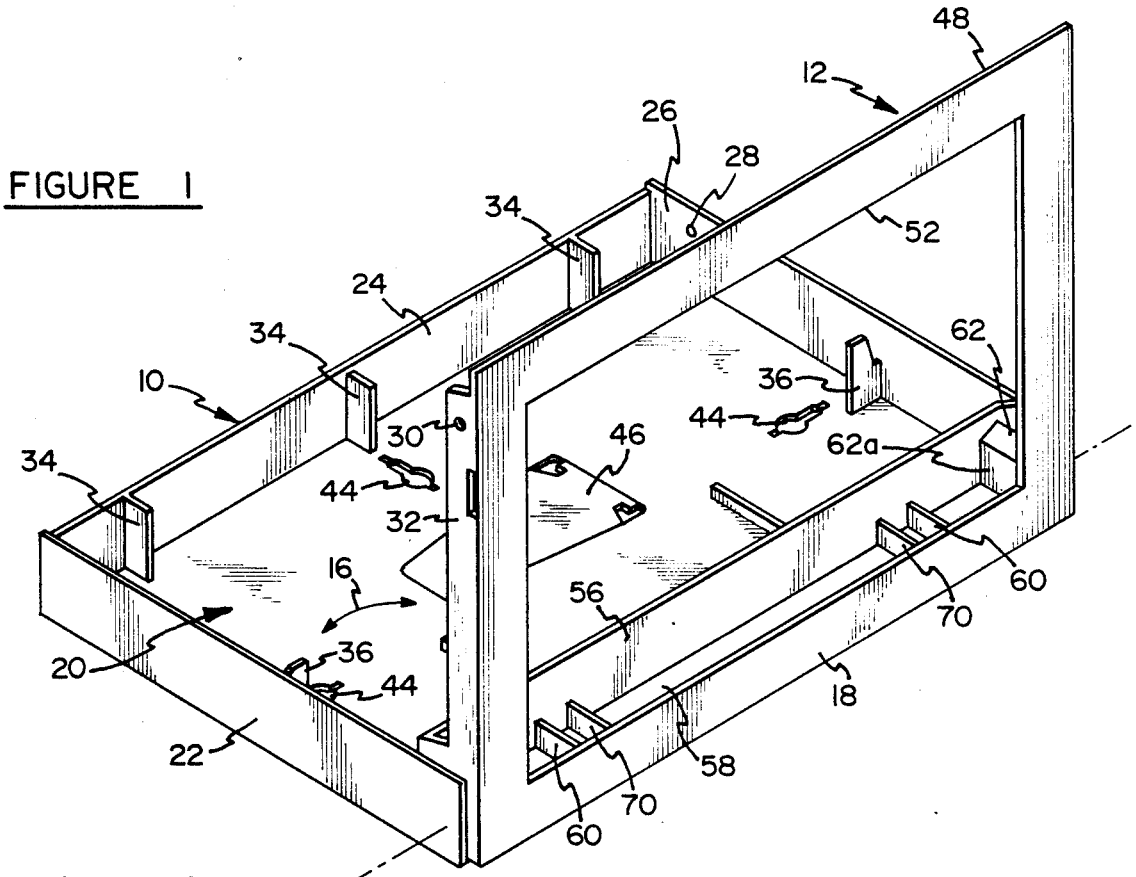
FIGURE 2
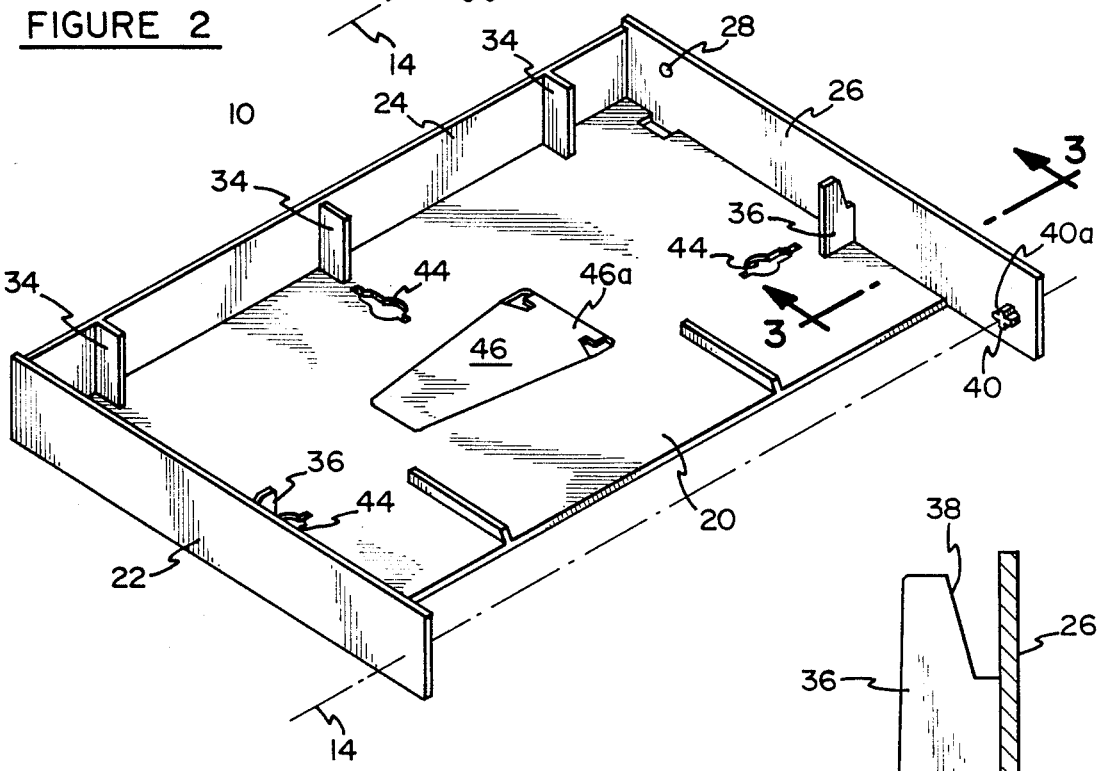
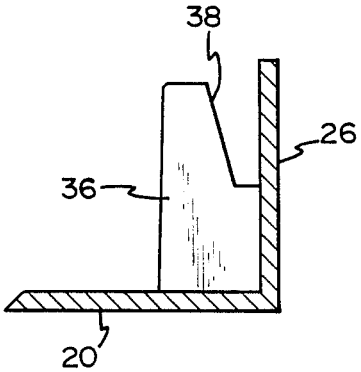
FIGURE 3

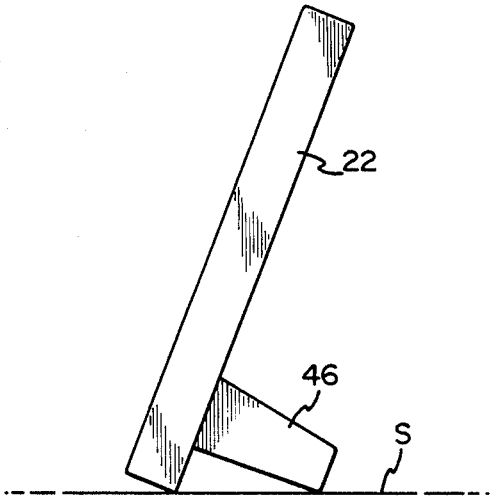
FIGURE 15
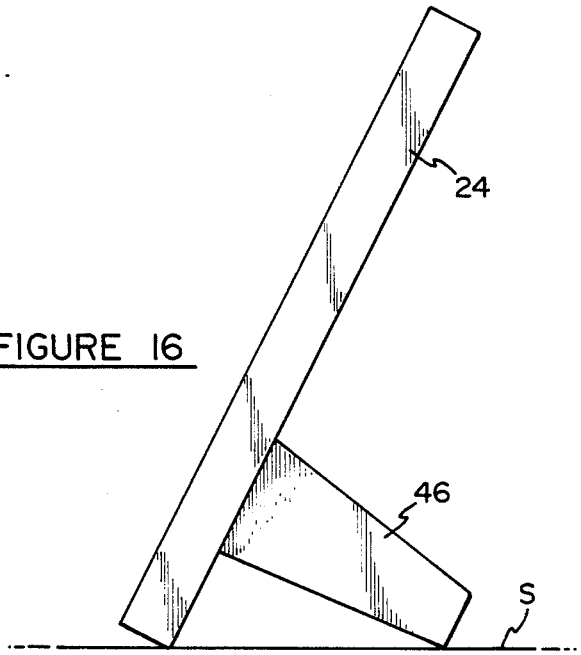
FIGURE 16
FIGURE 17
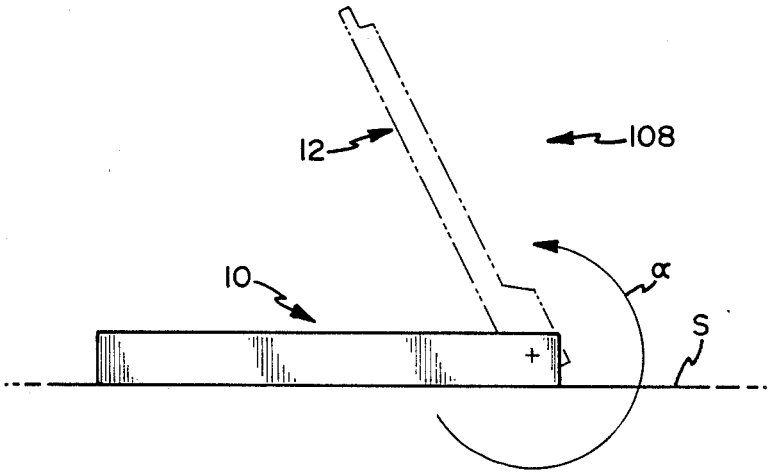

DISPLAY AND STORAGE CONTAINER WITH A LINER HAVING A SPACER FLAP FOR PHOTOGRAPHIC PRINTS

BACKGROUND OF THE INVENTION

The present invention relates to a container for displaying a photograph and for storing a stack of photographic prints and their negatives.

It is commonplace within the photographic processing industry for photographers to mail or otherwise deliver rolls of exposed film to a processor to develop the exposed film and to provide finished photographic prints which are then returned to the photographer. Typically, the photographic prints and the negatives are returned to the photographer in an envelope-type device made of paper, thin cardboard or the like. While such materials have the benefit of being inexpensive to produce, they do not provide a durable storage container for either the prints or the negatives. The flimsiness of the envelope may allow the prints and the negatives to bend and deform unless they are carefully stored by the photographer. Also, such envelopes typically do not provide for the display of any of the photographic prints.

Various attempts at obviating these drawbacks of the typical photo print envelope have been made in the past. Typically these have involved containers made from a more durable material, such as thin plastic, which are capable of both storing a stack of photographic prints and, in some cases, displaying one of the prints. However, such containers have proven to be rather complex, thereby increasing their manufacturing costs and preventing their widespread acceptance and usage by photographic film processors.

SUMMARY OF THE INVENTION

The present invention relates to a container for storing a stack of photographic prints and their negatives as well as for displaying one of the photographs. The container has a base to which a cover is pivotally attached. The cover has a front wall with a peripheral contour and defines a display opening having a contour smaller than the front wall peripheral contour.

The cover has a transport wall spaced from the front wall to define a space therebetween sufficient to accommodate a stack or photographic prints. Locating elements extend between the transport wall and the front wall to precisely locate the stack of photographic prints with respect to the display opening. A transparent window may be attached to the front wall to protect the uppermost print of the stack which is visible through the display opening.

The invention also may include a liner folded into a generally "U"-shaped cross-section to accommodate the stack of photographic prints therein. The liner, which may have a front panel and a rear panel is placed in the cover, along with the stack of photographic prints. One of the photographs may be placed between the front panel of the liner and the front wall of the cover for display purposes. The liner may also include an envelope portion to store the negatives. The depth of the container is such that the stack of photographs as well as the negatives are accommodated between the cover and the base when these are in their closed positions.

When the cover and base are closed, the container not only stores the stack of photographic prints and the negatives, but also provides a convenient device for displaying one of the prints. The base provides openings for hanging the container in a plurality of orientations and also provides a stand for supporting the container on a horizontal surface in a variety of orientations.

The container according to the invention provides a secure storage and display device for the stack of photographic prints and negatives, and one which is also simple in construction to minimize manufacturing costs to thereby overcome the drawbacks of the known containers.

BRIEF DESCRIPTION OF THE DRAWINGS

FIG. 1 is a perspective view of the container according to the invention showing the cover opened.

FIG. 2 is a perspective view of the base member of the container of FIG. 1.

FIG. 3 is a partial, cross-sectional view taken along line A—A in FIG. 2.

FIG. 15 is a side view of the container according to the invention illustrating a first display orientation.

FIG. 16 is a side view of the container according to the invention illustrating a second display orientation.

FIG. 17 is a side view of the container according to the invention illustrating a third display orientation.

DETAILED DESCRIPTION OF THE PREFERRED EMBODIMENTS

Figure 4:
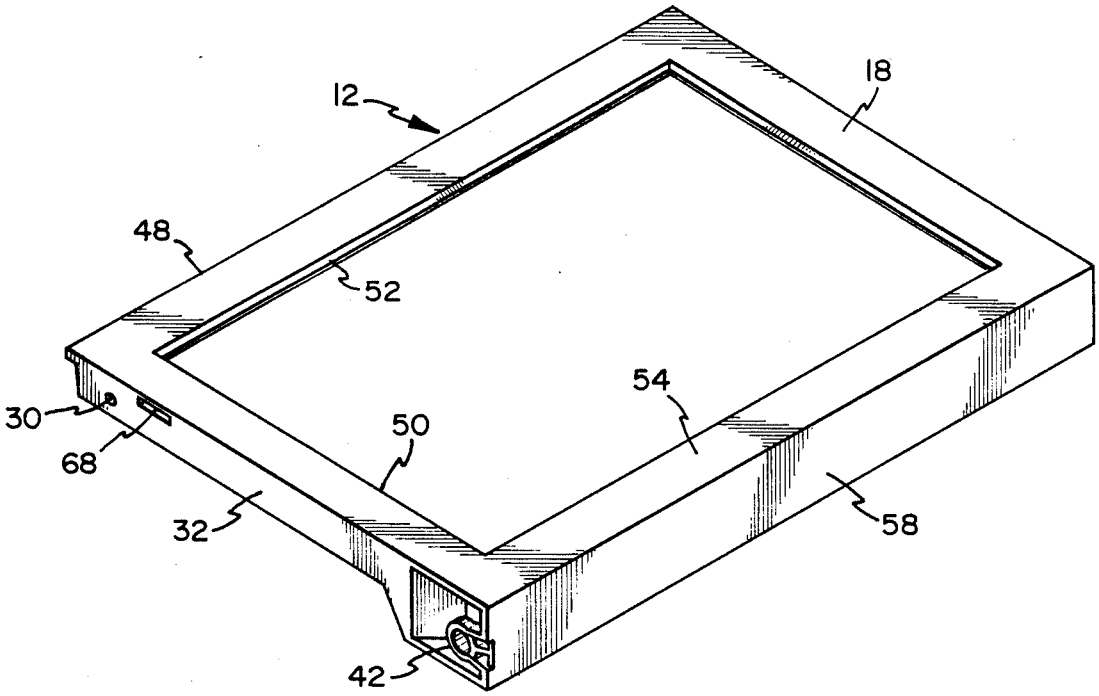
FIG. 4 is a perspective view of the cover member according to the invention.
Figure 18:
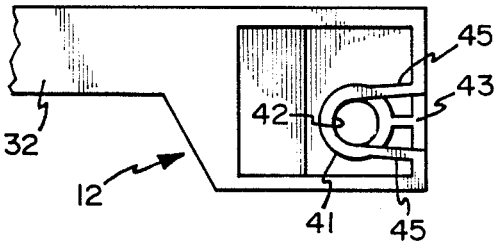
FIG. 18 is an enlarged, partial side view of the cover attaching structure.
Figure 5:
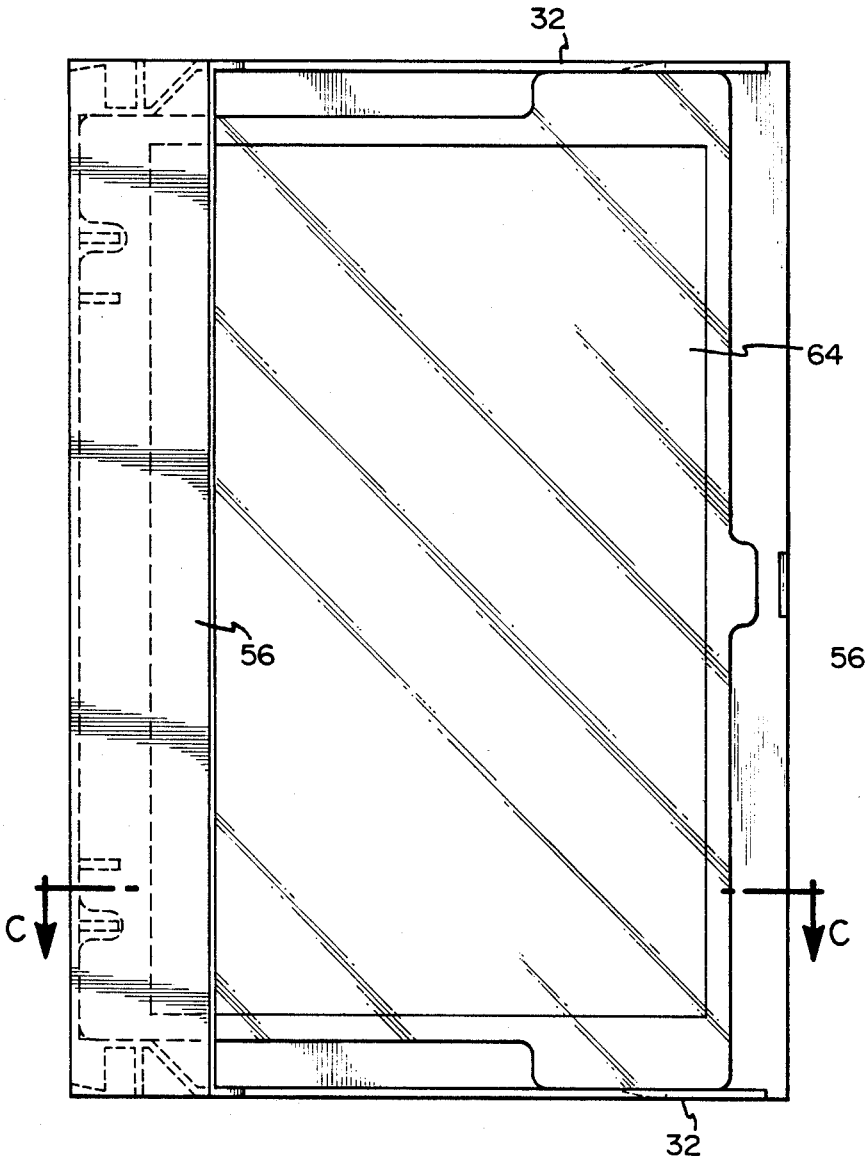
FIG. 5 is a rear view of the cover member shown in FIG. 4.
Figure 6:
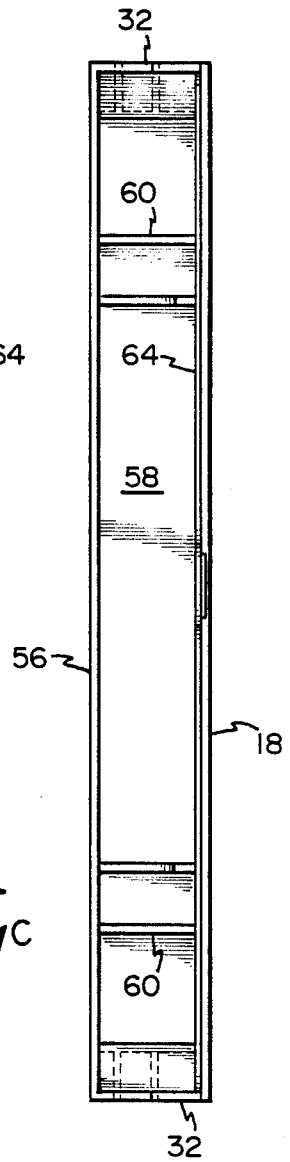
FIG. 6 is a side view of the cover member illustrated in FIG. 5.

The container according to the invention, as illustrated in FIG. 1, comprises a base member 10 with a cover member 12 pivotally attached thereto so as to be rotatable about axis 14. Cover member 12 is rotatable about axis 14 in the direction of arrows 16 such that the base member 10 and the cover member 12 are movable between closed and opened positions. In the closed positions, front wall 18 of the cover member 12 extends approximately parallel to rear wall 20 of base member 10 and lies approximately flush with the top edges of connected side walls 22, 24 and 26 extending upwardly from rear wall 20. Cover member 12 is latched in the closed position by the engagement of latching lugs 28, formed on sidewalls 22 and 26, respectively, with openings 30 defined by sidewalls 32 of cover member 12. Side walls 22, 26 engage the cover member 12 at free end portions intersecting axis 14 as shown in FIG. 2.

Spacer elements 34 extend inwardly from sidewall 24. Wedge cam elements 36 extend inwardly from sidewalls 22 and 26, respectively, and define angled wedge surfaces 38, shown in detail in FIG. 3, adapted to engage sidewalls 32 of the cover member as the members are closed. When in their closed positions, the wedge surface 38 urges the sidewalls 22 and 26 into close proximity with the sidewalls 32 of the cover member.

Figure 7:
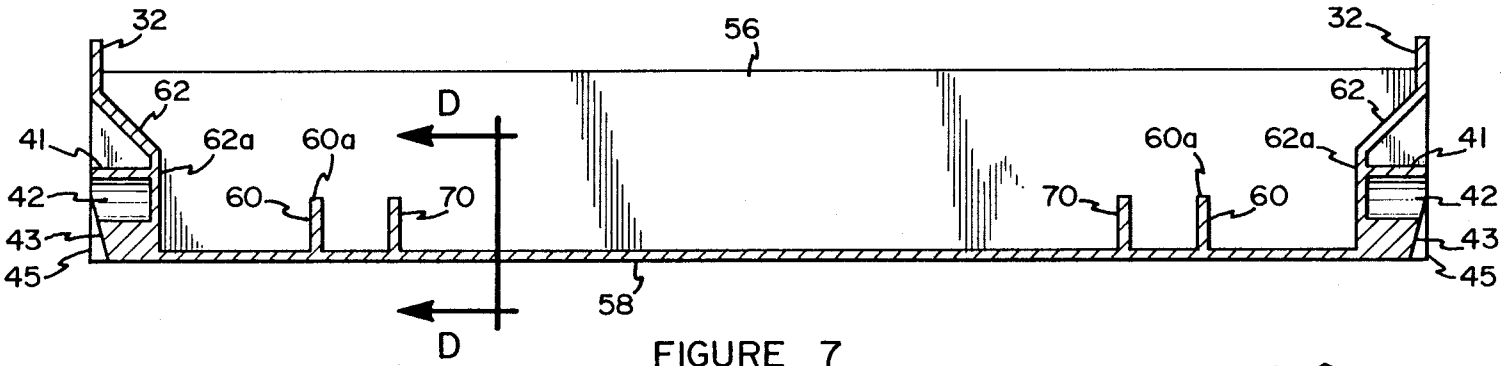
FIG. 7 is a cross-sectional view taken along line B—B in FIG. 8.

Pivot lugs 40 extend inwardly from sidewalls 22 and 26, respectively, and are centered on pivot axis 14. The lugs 40 are formed on portions of side walls 22 and 26 extending beyond rear wall 20 which have a certain degree of resiliency. A portion of each lug may be bevelled as illustrated at 40*a* in FIG. 2. Pivot lugs 40 snap fit into pivot openings 42 formed on the cover member 12 so as to pivotally retain the cover member 12 on the base member 10. Pivot openings 42 are defined by bosses 41, which may be integrally formed on cover 12. An outer surface of bosses 41 is also bevelled as at 43 in FIG. 7. Bevelled surface 43 along with guide walls 45 guides the pivot lugs 40 into snap-fit engagement with openings 42 as the cover member 12 and the base member 10 are urged toward each other. The resiliency of side walls 22 and 26 permits the lugs 40 to slide along surfaces 43 and to "snap" into openings 42. Guide walls 45 insure that lugs 40 are guided into openings 42.

Rear wall 20 defines a plurality of hanger openings 44 at various locations. The hanger openings 44 are adapted to engage a standard wall picture support to enable the container to be hung from such support in a variety of orientations.

A support element 46 is removably formed in rear wall 20. If it is desired to place the container on a generally horizontal surface in a display orientation, the support element is removed from the rear wall 20 and tab 46*a* is engaged with one of the openings 44 such that the support element 46 extends generally perpendicular to the plane of rear wall 20. The support element 46 acts as a brace to support the container on the surface in one of a variety of orientations.

Cover member 12 has a front wall 18 defining a peripheral contour 48. Although peripheral contour 48 is illustrated being generally rectangular, it is to be understood that other peripheral contour shapes may be utilized without exceeding the scope of this invention. Front wall 18 also defines a display opening 50 having a display opening contour 52 smaller than peripheral contour 48. In this particular instance, display opening contour 52 is also illustrated as being rectangular, but other contour shapes may be utilized without exceeding the scope of this invention. A display frame 54 is thus defined between display contour 52 and peripheral contour 48.

Cover member 12 also comprises transport wall 56 extending generally parallel to front wall 18, but spaced therefrom a distance sufficient to accommodate a stack of photographic prints in sheet form therebetween. Transport wall 56 extends between sidewalls 32 and may be further joined to front wall 18 by sidewall 58.

Alignment means are also included on cover member 12 between transport wall 56 and front wall 18 to align the sheet stack of photographic prints with the contour 52 of the display opening 50. The alignment means includes alignment elements 60 extending inwardly from sidewall 58 between transport wall 56 and front wall 18. Alignment elements 60 define surfaces 60*a* upon which an edge of the stack of photographic prints rests to locate the stack with respect to the display opening 50 in a first direction. Locating elements 62 extend inwardly from sides 32 and define a locating surface 62*a* which bears against opposite edges of the stack of photographic prints and locates the stack in a second direction extending generally perpendicular to the first direction. Since the alignment elements contact edges of the entire stack of photographic prints, the entire stack will be in alignment with the display opening 50.

Figure 9:
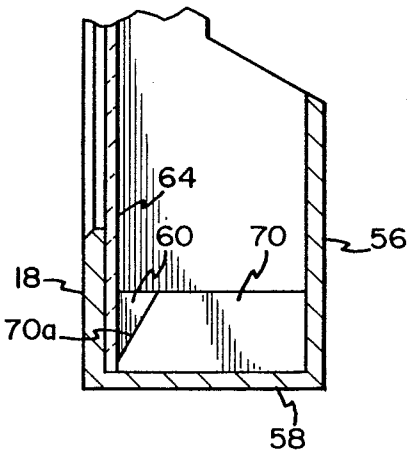
FIG. 9 is a partial, cross-sectional view taken along line D—D in FIG. 7.
Figure 8:
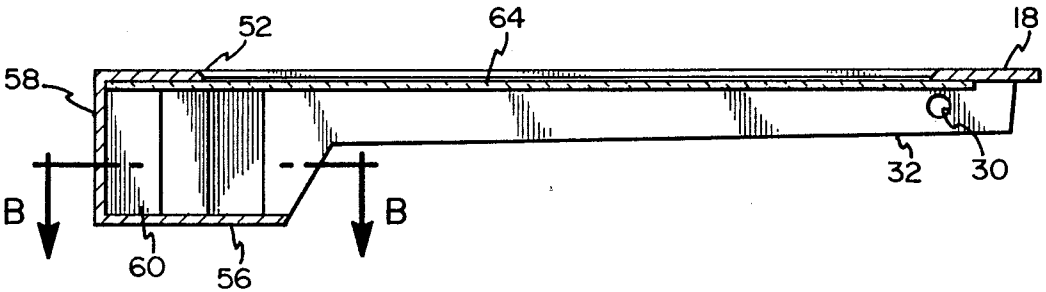
FIG. 8 is a cross-sectional view taken along line C—C in FIG. 5.
Figure 10:
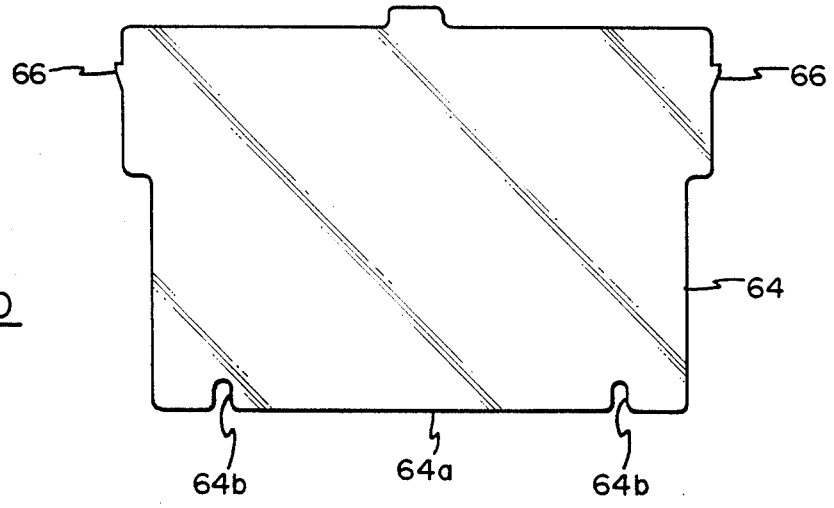
FIG. 10 is a front view of a window member associated with the cover member of FIG. 4.
Figure 11:
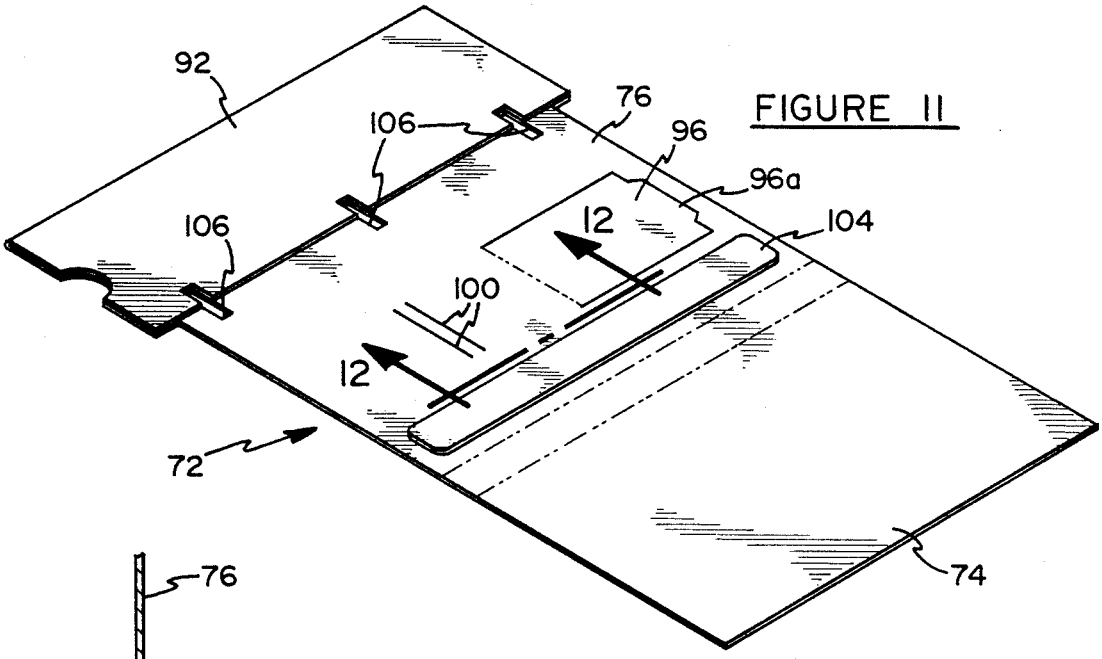
FIG. 11 is a perspective view of the liner member according to the invention.

A window member 64 may be attached to the front wall 18 of the cover member so as to extend completely over the display opening 50. Window member 64 may be formed of a thin sheet of transparent plastic material exhibiting a certain degree of resiliency and may have attaching tabs 66 extending from either side to engage correspondingly located slots 68 defined by sidewalls 32. An edge 64*a* of the window member rests on sidewall 58 and is located and retained in this position by locating members 70. Locating members 70 each have a wedge surface 70*a* adapted to contact the edge 64*a* of the window member as it is inserted and to urge this edge against front wall 18, as indicated in FIG. 9. Cutouts 64*b* enable the window member 64 to be inserted over the alignment elements 60. The locating elements 70 and the engagement of tabs of 66 with slots 68 hold the window member 64 in place against the front wall 18 of cover member 12.

Liner member 72 is illustrated in FIGS. 11–14 and comprises front stack panel 74, rear stack panel 76, a first envelope panel 78 and a second envelope panel 80. Crease lines 82 and 84 extend across the entire height of the blank 72 between front stack panel 74 and rear stack panel 76 to enable the respective panels to be folded over to extend generally parallel to each other. This forms the liner into a generally "U"-shaped cross-section with the front stack panel 74 spaced from the rear stack panel 76 a distance sufficient to accommodate the stack of photographic prints therebetween. Additional crease lines 86 and 88 enable the first and second envelope panels 78 and 80 to be folded over onto each other and fastened into place by tab portion 90. Tab portion 90 may have adhesive applied thereto in order to hold the envelope panels together in the position shown in FIG. 11. Thus fastened, panels 78 and 80 form an envelope pouch 92 attached to rear stack panel 76 by a perforation line 94. Envelope pouch 92 accommodates the negatives corresponding to the stack of photographic prints and may include reordering information should the user desire to have additional prints made. The envelope pouch 92 may be physically separated from the rear stack panel 76 along perforation line 94 to facilitate the mailing of the negatives to a developer for additional prints. The height of envelope panel 78 may be greater than that of envelope panel 80 so as to define a lip portion 78*a* when the envelope pouch is formed. Lip portion 78*a* assists in inserting the photographic negative into the envelope pouch.

Figure 13:
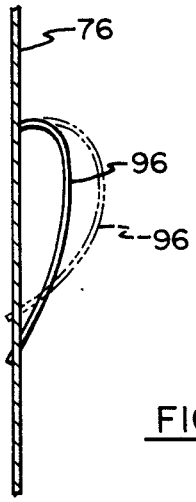
FIG. 13 is a partial cross-section taken along line E—E in FIG. 12.
Figure 12:
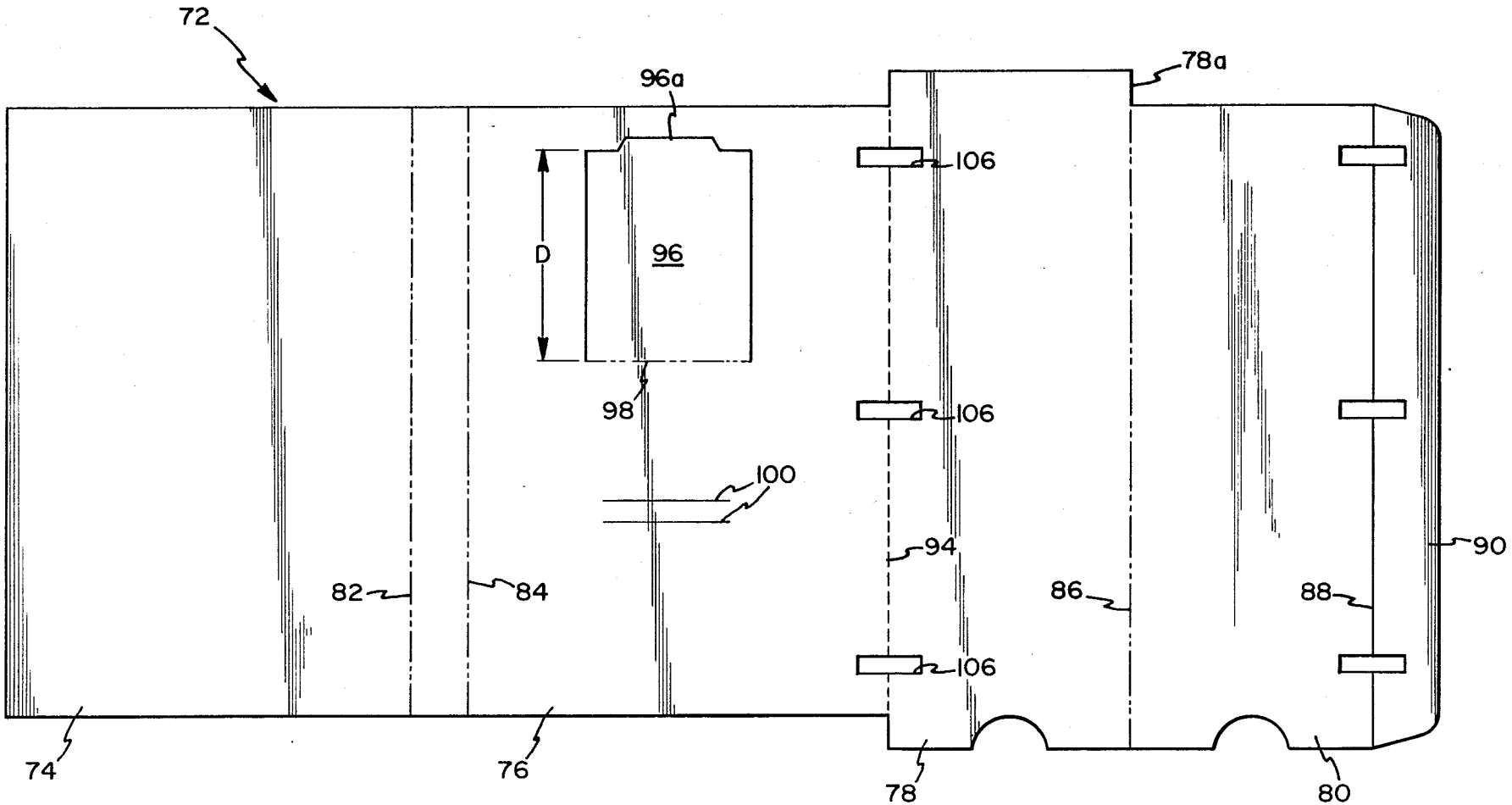
FIG. 12 is a plan view of a blank utilized to form the liner member.

A spacer flap 96 is formed in the rear stack panel 76 and is adapted to fold outwardly along crease line 98 such that tab 96*a* may be inserted into one of a plurality of slots 100 extending partially across the width of the rear stack panel 76. The distance between each of the slits 100 and the crease line 98 is less than the distance d between the crease line 98 and the distal end of spacer flap 96 enabling the flap to be adjusted to various positions, as illustrated in FIG. 13. In each position, the flap extends a distance from the plane of rear stack panel 76.

Figure 14:
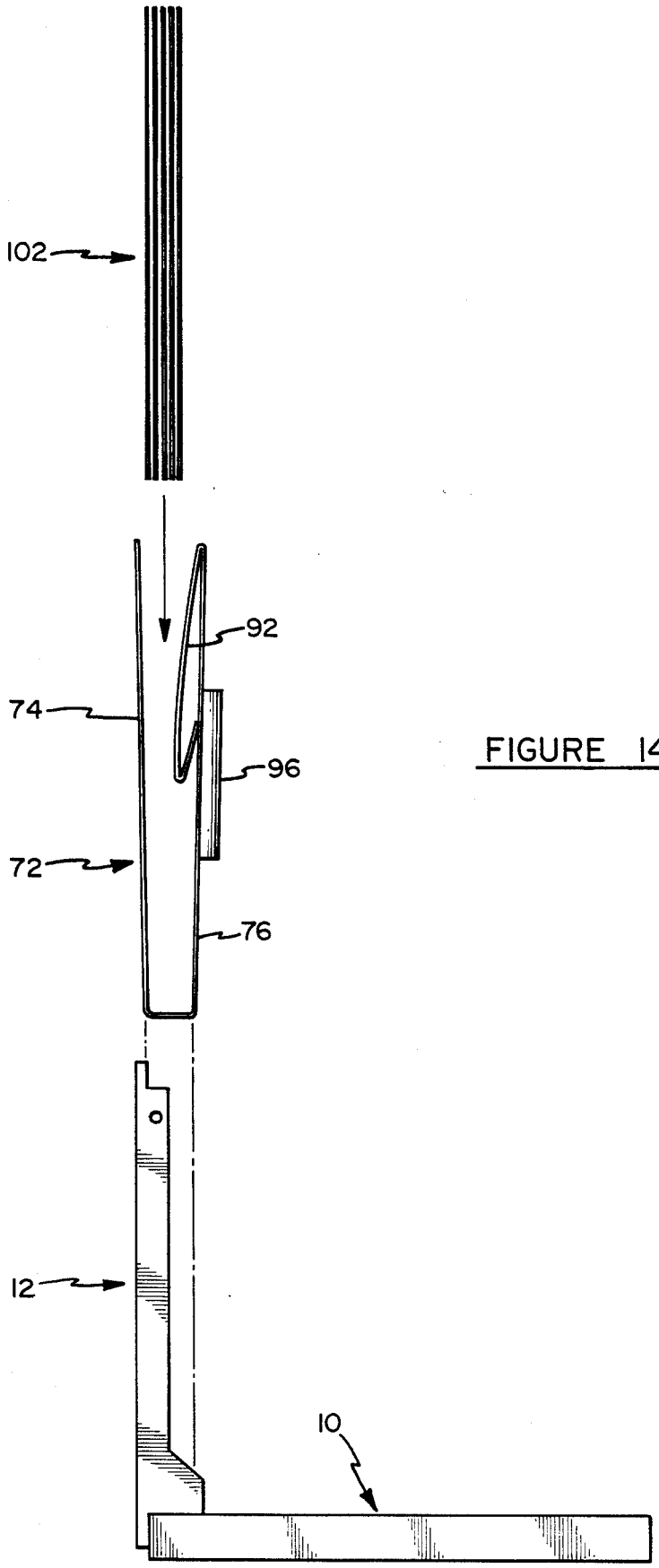
FIG. 14 is an exploded side view of a container according to the invention with the liner member and a stack of photographic prints.

In use, the liner member 72 is folded into its "U"-shape as illustrated in FIG. 14, and the stack of photographic prints 102 is inserted between front stack panel 74 and rear stack panel 76. The negatives corresponding to the photographic prints are placed in the envelope pouch 92 and the entire assembly is inserted into cover member 12 such that the liner and the stack of photographic prints are located between the transport wall 56 and the front wall 18 of the cover member in alignment with display opening 50. The portion of front stack panel 74 extending over the display opening 50 may have indicia printed thereon such as advertising logos, etc.

A removable adhesive label 104 may be located on the rear stack panel 76 and may have room to place identification relating to the specific owner or subject matter of the photographic prints. This label may be removed from liner member 72 and adhesively attached to one of the sidewalls of the container to provide desired identification of the photographer or the subject matter of the prints.

Upon closure of cover member 12, alignment slots 106 formed in the liner member will align themselves with spacer elements 34 formed on the base member 10.

Since the number of sheets of prints in the stack may vary according to the number developed from film rolls, spacer flap 96 may be selectively inserted into one of the slots 100 such that it may bear against the rear wall 20 of the base member and urge the stack of prints, as well as front stack panel 74 against front wall 18 of the cover member irrespective of the total stack thickness, when the container is closed. It is envisioned that the liner member will be made from a heavy paper or a lightweight cardboard and that the spacer flap 96 will possess a certain amount of resiliency.

When it is desired to display a photograph from the stack of photographic prints, the user need only remove the desired print from the stack and place it between the front stack panel 74 and of the front wall 18 of the cover member. The print will be automatically located with respect to the displace opening 50 by the alignment and locating elements 60 and 62. Upon closure of cover member, the displayed print will be urged against the front wall 18 by the stack of photographic prints and the the spacer flap 96 bearing against rear wall 20.

The support 46 may be positioned in one of the plurality of slots 44 to enable the container to be displayed on a surface S with its generally shorter side extending vertically, as indicated in FIG. 20, or its longer side extending this direction, as indicated in FIG. 21. The plurality of openings 44 also enable the container to be hung from a wall support in a variety of orientations.

The cover member 12 is pivotally attached to the base member 10 such that it may pivot, from its closed position, through an angle equal to or greater than 270°. As illustrated in FIG. 17, this enables the inverted base member 10 to support the cover member 12 such that the photographic print may be viewed in the direction of arrow 108. This display position also provides ready access to the stack of photographic prints.

The foregoing description is provided for illustrative purposes only and should not be construed as in any way limiting this invention, the scope of which is defined solely by the appended claims.

What is claimed is:

1. A container for accommodating a stack of sheets having a variable number of sheets comprising:

(a) a base member having a rear wall;

(b) a cover member attached to the base member such that the members aremovable between closed and opened positions, the cover member having a front wall with a peripheral contour;

(c) a liner member located in the container and having a rear panel adapted to extend between the stack of sheets and the rear wall of the base member;

(d) adjustable spacer means formed on the rear panel of the line member adapted to bear against the rear wall of the base member when the cover and base members are in their closed positions so as to urge the liner and the stack of sheets toward the front wall of the cover member;

(e) transport means on the cover member adapted to hold the stack of sheets and the liner member on the cover member in the closed and opened positions; and, (f) alignment means on the cover member adapted to align the liner member and the stack of sheets with respect to the front wall of the cover member.

2. The container according to claim 1 wherein the liner member further comprises a front panel adapted to extend between the stack of sheets and the front wall of the cover member.

3. The container according to claim 2 wherein the liner member further comprises a bottom panel extending between the front and rear panels such that the liner member is generally "U"-shaped in cross-section.

4. The container according to claim 2 wherein the front wall of the cover member defines a display opening having a contour smaller than the peripheral contour of the front wall.

5. The container according to claim 4 wherein the front panel of the liner member defines a peripheral contour larger than that of the display opening in the front wall of the cover member.

6. The container according to claim 5 wherein the alignment means includes a means to align the liner member with respect to the front wall of the cover member such that the front panel extends over the display opening.

7. The container according to claim 6 further comprising:

(a) a transparent window member; and, (b) means to attach the window member to the cover member such that it extends over the display opening between the front panel of the liner member and the front wall of the cover member.

8. The container according to claim 7 wherein the means to attach the window member to the cover member comprises:

(a) means on the cover member adapted to contact the window member so as to urge it against the cover member; and, (b) retaining means on the window engaging said means on the cover member to retain the window member in position against the cover member.

9. The container according to claim 8 wherein the retaining means comprises:

(a) at least one slot defined by the cover member; and, (b) at least one tab extending from the window member so as to engage the at least one slot.

10. The container according to claim 1 further comprising envelope means on the liner member defining a separate pouch closed on at least two sides.

11. The container according to claim 10 wherein the envelope means is removably attached to the rear panel of the liner member.

12. The container according to claim 1 wherein the transport means comprises:

(a) a transport wall extending generally parallel to the front wall of the cover member, but spaced therefrom a distance sufficient to accommodate the liner member and the stack of sheets therebetween; and, (b) side walls connecting the transport wall and the front wall of the cover member.

13. The container according to claim 12 wherein the alignment means comprises:

(a) first spacer means extending between the front wall and the transport wall and adapted to align the stack with respect to the peripheral contour of the cover member in a first direction; and, (b) second spacer means extending inwardly from the side walls and between the face and the transport wall adapted to contact edges of the sheets in the stack to align the stack with respect to the peripheral contour of the cover member in a second direction generally perpendicular to the first direction.

14. The container according to claim 13 wherein the front wall of the cover member defines a display opening having a contour smaller than the peripheral contour of the front wall.

15. The container according to claim 14 further comprising window locating means on the cover member between the front wall and the transport wall adapted to contact a window member covering the display opening so as to urge the window member against the front wall of the cover member.

16. The container according to claim 15 wherein the first spacer means comprises a plurality of first spacer elements formed on the cover member.

17. The container according to claim 16 wherein the second spacer means comprises second spacer elements extending inwardly from opposite sides of the cover member.

18. The container according to claim 17 wherein the window locating means comprises at least one window locating element extending from the transport wall toward the front wall of the cover member, the locating element defining a wedge surface facing toward the front wall adapted to urge a window member contacting the wedge surface into contact with the front wall.

19. The container according to claim 1 further comprising:

(a) at least one base side wall extending from the base member;

(b) at least one cover side wall extending from the cover member;

(c) a cam element on one of the members and defining a wedge surface located so as to contact the side wall of the other member when the members are in their closed positions so as to urge the cover side wall and base side wall towards each other.

20. The container according to claim 1 further comprising a plurality of hanger openings defined by the base member to enable the container to be suspended in one of a plurality of orientations.

21. The container according to claim 1 further comprising:

(a) a support element removably attached to the base member; and, (b) a plurality of openings defined by the base member adapted to be engaged by the support element after removal from the base member to support the container on a generally horizontal surface in one of a plurality of orientations.

22. The container according to claim 1 further comprising pivot means attaching the cover member to the base member such that the members are pivotable about an axis extending generally parallel to the front wall the cover member, said cover member being pivotable with respect to the base member through an angle of at least 270°, and stop means on the base for the cover to limit maximum rotation of the cover member towards the open position so the cover will remain upstanding for enabling the cover member to be supported in a display position on the base member when the cover is pivoted to the stop means and the base is supported in an inverted horizontal position.

23. The container according to claim 22 wherein the pivot means comprises:

(a) pivot lugs on the base member; and, (b) bosses on the cover member defining pivot openings to pivotally accommodate the pivot lugs.

24. The container according to claim 23 wherein the pivot lugs extend from opposite side walls on the base member and snap fit into the pivot openings.

25. The container according to claim 23 further comprising bevelled guide surfaces defined by the bosses so as to guide the pivot lugs into engagement with the pivot openings.

26. The container according to claim 1 further comprising:

(a) at least one base side wall extending from the base member;

(b) at least one cover side wall extending from the cover member;

(c) a cam element located on one of the members and defining a wedge surface located so as to contact the side wall on the other member when the members are in their closed positions so as to urge the cover side wall and base side wall towards each other.

* * * * *